US005706043A

United States Patent [19]

Okada et al.

[11] Patent Number: 5,706,043

[45] Date of Patent: Jan. 6, 1998

[54] DRIVING METHOD OF THERMAL PRINTER

[75] Inventors: Takayuki Okada; Mitsuo Tashiro, both of Tokyo, Japan

[73] Assignee: Seiko Precision Inc., Tokyo, Japan

[21] Appl. No.: 387,556

[22] Filed: Feb. 13, 1995

[30] Foreign Application Priority Data

Feb. 17, 1994 [JP] Japan ..... 6-020304

[51] Int. Cl.[6] ..... B41J 2/36; B41J 2/38

[52] U.S. Cl. ..... 347/185; 347/186; 347/189; 347/194; 347/211

[58] Field of Search ..... 347/185, 186, 347/189, 184, 211; 400/120.08, 120.14

[56] References Cited

U.S. PATENT DOCUMENTS 4,432,001 2/1984 Inui et al. ..... 347/186

FOREIGN PATENT DOCUMENTS 3732868 4/1989 Germany ..... 347/186
3833746 4/1990 Germany ..... 347/186
63-307970 12/1988 Japan ..... 347/186

*Primary Examiner*—Huan H. Tran
*Attorney, Agent, or Firm*—Amster Rothstein & Ebenstein

[57] ABSTRACT

In a driving method of a thermal printer, in which method heating elements are driven by strobe pulses consisting of preheat pulses and subsequent drive pulses that depend on a gradation level, the preheat pulse width and the frequency of basic clock pulses that are used to generate the strobe pulses are switched linearly with the temperature of a thermal head unit. In particular, based on data of preheat pulse widths and basic clock pulse frequencies for respective experimental head temperatures, preheat pulse widths and basic clock pulse frequencies for the other temperatures are calculated.

17 Claims, 7 Drawing Sheets

| HEAD TEMP (°C) | STROBE PULSES | | | | | | | | | | | | | | | | BASIC CLOCK PULSES | |
|---|---|---|---|---|---|---|---|---|---|---|---|---|---|---|---|---|---|---|
| | PREHEAT PULSES | | DRIVE PULSES | | | | | | | | | | | | | | VCO (MHz) | Period (ns) |
| 0-1 | 187 | 187 | 128 | 128 | 128 | 128 | 128 | 128 | 128 | 64 | 32 | 17 | 9 | 5 | 3 | 2 | 8.675 | 115.27 |
| 2-3 | 181 | 181 | 128 | 128 | 128 | 128 | 128 | 128 | 128 | 64 | 32 | 17 | 9 | 5 | 3 | 2 | 8.772 | 114 |
| 4-5 | 175 | 175 | 128 | 128 | 128 | 128 | 128 | 128 | 128 | 64 | 32 | 17 | 9 | 5 | 3 | 2 | 8.869 | 112.75 |
| 6-7 | 169 | 169 | 128 | 128 | 128 | 128 | 128 | 128 | 128 | 64 | 32 | 17 | 9 | 5 | 3 | 2 | 8.966 | 111.53 |
| 8-9 | 163 | 163 | 128 | 128 | 128 | 128 | 128 | 128 | 128 | 64 | 32 | 17 | 9 | 5 | 3 | 2 | 9.063 | 110.34 |
| 10-11 | 157 | 157 | 128 | 128 | 128 | 128 | 128 | 128 | 128 | 64 | 32 | 17 | 9 | 5 | 3 | 2 | 9.16 | 109.17 |
| 12-13 | 151 | 151 | 128 | 128 | 128 | 128 | 128 | 128 | 128 | 64 | 32 | 17 | 9 | 5 | 3 | 2 | 9.257 | 108.03 |
| 14-15 | 145 | 145 | 128 | 128 | 128 | 128 | 128 | 128 | 128 | 64 | 32 | 17 | 9 | 5 | 3 | 2 | 9.354 | 106.91 |
| 16-17 | 139 | 139 | 128 | 128 | 128 | 128 | 128 | 128 | 128 | 64 | 32 | 17 | 9 | 5 | 3 | 2 | 9.451 | 105.81 |
| 18-19 | 133 | 133 | 128 | 128 | 128 | 128 | 128 | 128 | 128 | 64 | 32 | 17 | 9 | 5 | 3 | 2 | 9.548 | 104.73 |
| 20-21 | 127 | 127 | 128 | 128 | 128 | 128 | 128 | 128 | 128 | 64 | 32 | 17 | 9 | 5 | 3 | 2 | 9.645 | 103.68 |
| 22-23 | 121 | 121 | 128 | 128 | 128 | 128 | 128 | 128 | 128 | 64 | 32 | 17 | 9 | 5 | 3 | 2 | 9.742 | 102.65 |
| 24-25 | 115 | 115 | 128 | 128 | 128 | 128 | 128 | 128 | 128 | 64 | 32 | 17 | 9 | 5 | 3 | 2 | 9.839 | 101.64 |
| 26-27 | 109 | 109 | 128 | 128 | 128 | 128 | 128 | 128 | 128 | 64 | 32 | 17 | 9 | 5 | 3 | 2 | 9.936 | 100.64 |
| 28-29 | 103 | 103 | 128 | 128 | 128 | 128 | 128 | 128 | 128 | 64 | 32 | 17 | 9 | 5 | 3 | 2 | 10.033 | 99.67 |
| 30-31 | 97 | 97 | 128 | 128 | 128 | 128 | 128 | 128 | 128 | 64 | 32 | 17 | 9 | 5 | 3 | 2 | 10.13 | 98.72 |
| 32-33 | 91 | 91 | 128 | 128 | 128 | 128 | 128 | 128 | 128 | 64 | 32 | 17 | 9 | 5 | 3 | 2 | 10.227 | 97.78 |
| 34-35 | 85 | 85 | 128 | 128 | 128 | 128 | 128 | 128 | 128 | 64 | 32 | 17 | 9 | 5 | 3 | 2 | 10.324 | 96.86 |
| 36-37 | 79 | 79 | 128 | 128 | 128 | 128 | 128 | 128 | 128 | 64 | 32 | 17 | 9 | 5 | 3 | 2 | 10.421 | 95.96 |
| 38-39 | 73 | 73 | 128 | 128 | 128 | 128 | 128 | 128 | 128 | 64 | 32 | 17 | 9 | 5 | 3 | 2 | 10.510 | 95.08 |
| 40-41 | 67 | 67 | 128 | 128 | 128 | 128 | 128 | 128 | 128 | 64 | 32 | 17 | 9 | 5 | 3 | 2 | 10.615 | 94.21 |
| 42-43 | 61 | 61 | 128 | 128 | 128 | 128 | 128 | 128 | 128 | 64 | 32 | 17 | 9 | 5 | 3 | 2 | 10.712 | 93.35 |
| 44-45 | 55 | 55 | 128 | 128 | 128 | 128 | 128 | 128 | 128 | 64 | 32 | 17 | 9 | 5 | 3 | 2 | 10.809 | 92.52 |
| 46-47 | 49 | 49 | 128 | 128 | 128 | 128 | 128 | 128 | 128 | 64 | 32 | 17 | 9 | 5 | 3 | 2 | 10.906 | 91.69 |
| 48-49 | 43 | 43 | 128 | 128 | 128 | 128 | 128 | 128 | 128 | 64 | 32 | 17 | 9 | 5 | 3 | 2 | 10.003 | 90.88 |
| 50-51 | 37 | 37 | 128 | 128 | 128 | 128 | 128 | 128 | 128 | 64 | 32 | 17 | 9 | 5 | 3 | 2 | 11.1 | 90.09 |
| 52-53 | 31 | 31 | 128 | 128 | 128 | 128 | 128 | 128 | 128 | 64 | 32 | 17 | 9 | 5 | 3 | 2 | 11.197 | 89.31 |
| 54-55 | 25 | 25 | 128 | 128 | 128 | 128 | 128 | 128 | 128 | 64 | 32 | 17 | 9 | 5 | 3 | 2 | 11.294 | 88.54 |
| 56-57 | 19 | 19 | 128 | 128 | 128 | 128 | 128 | 128 | 128 | 64 | 32 | 17 | 9 | 5 | 3 | 2 | 11.391 | 87.79 |
| 58-59 | 13 | 13 | 128 | 128 | 128 | 128 | 128 | 128 | 128 | 64 | 32 | 17 | 9 | 5 | 3 | 2 | 11.488 | 87.05 |
| 60-61 | 7 | 7 | 128 | 128 | 128 | 128 | 128 | 128 | 128 | 64 | 32 | 17 | 9 | 5 | 3 | 2 | 11.585 | 86.32 |
| 62-63 | 1 | 1 | 128 | 128 | 128 | 128 | 128 | 128 | 128 | 64 | 32 | 17 | 9 | 5 | 3 | 2 | 11.682 | 85.6 |

FIG. 2

FIG. 3

| GRADATION LEVEL | PATTERN DATA | | | | | | | | | | | | | | | | |
|---|---|---|---|---|---|---|---|---|---|---|---|---|---|---|---|---|---|
| 1 | 1 | 1 | 0 | 0 | 0 | 0 | 0 | 0 | 0 | 1 | 1 | 0 | 0 | 1 | 1 | 1 | a |
| 2 | 1 | 1 | 0 | 0 | 0 | 0 | 0 | 0 | 0 | 1 | 1 | 0 | 1 | 1 | 0 | 1 | |
| 3 | 1 | 1 | 0 | 0 | 0 | 0 | 0 | 0 | 0 | 1 | 1 | 1 | 0 | 0 | 1 | 1 | |
| 4 | 1 | 1 | 0 | 0 | 0 | 0 | 0 | 0 | 0 | 1 | 1 | 1 | 1 | 0 | 0 | 1 | |
| 5 | 1 | 1 | 0 | 0 | 0 | 0 | 0 | 0 | 0 | 1 | 1 | 1 | 1 | 1 | 1 | 1 | |
| 6 | 1 | 1 | 0 | 0 | 0 | 0 | 0 | 0 | 1 | 0 | 0 | 0 | 0 | 1 | 0 | 1 | |
| 7 | 1 | 1 | 0 | 0 | 0 | 0 | 0 | 0 | 1 | 0 | 0 | 0 | 1 | 0 | 1 | 1 | |
| 8 | 1 | 1 | 0 | 0 | 0 | 0 | 0 | 0 | 1 | 0 | 0 | 1 | 0 | 0 | 0 | 1 | |
| 9 | 1 | 1 | 0 | 0 | 0 | 0 | 0 | 0 | 1 | 0 | 0 | 1 | 0 | 1 | 1 | 1 | |
| 10 | 1 | 1 | 0 | 0 | 0 | 0 | 0 | 0 | 1 | 0 | 0 | 1 | 1 | 1 | 0 | 1 | |
| 11 | 1 | 1 | 0 | 0 | 0 | 0 | 0 | 0 | 1 | 0 | 1 | 0 | 0 | 0 | 1 | 1 | |
| 12 | 1 | 1 | 0 | 0 | 0 | 0 | 0 | 0 | 1 | 0 | 1 | 0 | 1 | 0 | 0 | 1 | |
| 13 | 1 | 1 | 0 | 0 | 0 | 0 | 0 | 0 | 1 | 0 | 1 | 0 | 1 | 1 | 1 | 1 | |
| 14 | 1 | 1 | 0 | 0 | 0 | 0 | 0 | 0 | 1 | 0 | 1 | 1 | 0 | 1 | 0 | 1 | |
| 15 | 1 | 1 | 0 | 0 | 0 | 0 | 0 | 0 | 1 | 0 | 1 | 1 | 1 | 0 | 1 | 1 | |
| 16 | 1 | 1 | 0 | 0 | 0 | 0 | 0 | 0 | 1 | 1 | 0 | 0 | 0 | 0 | 0 | 1 | |
| 17 | 1 | 1 | 0 | 0 | 0 | 0 | 0 | 0 | 1 | 1 | 0 | 0 | 0 | 1 | 1 | 1 | |
| 18 | 1 | 1 | 0 | 0 | 0 | 0 | 0 | 0 | 1 | 1 | 0 | 0 | 1 | 1 | 0 | 1 | |
| 19 | 1 | 1 | 0 | 0 | 0 | 0 | 0 | 0 | 1 | 1 | 0 | 1 | 0 | 0 | 1 | 1 | |
| 20 | 1 | 1 | 0 | 0 | 0 | 0 | 0 | 0 | 1 | 1 | 0 | 1 | 1 | 0 | 0 | 1 | |
| 21 | 1 | 1 | 0 | 0 | 0 | 0 | 0 | 0 | 1 | 1 | 0 | 1 | 1 | 1 | 1 | 1 | |
| 22 | 1 | 1 | 0 | 0 | 0 | 0 | 0 | 0 | 1 | 1 | 1 | 0 | 0 | 1 | 0 | 1 | |
| 23 | 1 | 1 | 0 | 0 | 0 | 0 | 0 | 0 | 1 | 1 | 1 | 0 | 1 | 0 | 1 | 1 | |
| 24 | 1 | 1 | 0 | 0 | 0 | 0 | 0 | 0 | 1 | 1 | 1 | 1 | 0 | 0 | 0 | 1 | |
| 25 | 1 | 1 | 0 | 0 | 0 | 0 | 0 | 0 | 1 | 1 | 1 | 1 | 0 | 1 | 1 | 1 | |
| 26 | 1 | 1 | 0 | 0 | 0 | 0 | 0 | 0 | 1 | 1 | 1 | 1 | 1 | 1 | 0 | 1 | |
| 27 | 1 | 1 | 0 | 0 | 0 | 0 | 0 | 1 | 1 | 0 | 0 | 0 | 0 | 0 | 1 | 1 | |
| 28 | 1 | 1 | 0 | 0 | 0 | 0 | 0 | 1 | 1 | 0 | 0 | 0 | 1 | 0 | 0 | 1 | |
| 29 | 1 | 1 | 0 | 0 | 0 | 0 | 0 | 1 | 1 | 0 | 0 | 0 | 1 | 1 | 1 | 1 | |
| 30 | 1 | 1 | 0 | 0 | 0 | 0 | 0 | 1 | 1 | 0 | 0 | 1 | 0 | 1 | 0 | 1 | b |
| 31 | 1 | 1 | 0 | 0 | 0 | 0 | 0 | 1 | 1 | 0 | 0 | 1 | 1 | 0 | 1 | 1 | |
| 32 | 1 | 1 | 0 | 0 | 0 | 0 | 0 | 1 | 1 | 0 | 1 | 0 | 0 | 0 | 0 | 1 | |
| 33 | 1 | 1 | 0 | 0 | 0 | 0 | 0 | 1 | 1 | 0 | 1 | 0 | 0 | 1 | 1 | 1 | |
| 34 | 1 | 1 | 0 | 0 | 0 | 0 | 0 | 1 | 1 | 0 | 1 | 0 | 1 | 1 | 0 | 1 | |
| 35 | 1 | 1 | 0 | 0 | 0 | 0 | 0 | 1 | 1 | 0 | 1 | 1 | 0 | 1 | 0 | 0 | |
| 36 | 1 | 1 | 0 | 0 | 0 | 0 | 0 | 1 | 1 | 0 | 1 | 1 | 1 | 1 | 0 | 0 | |
| 37 | 1 | 1 | 0 | 0 | 0 | 0 | 0 | 1 | 1 | 1 | 0 | 0 | 0 | 1 | 0 | 1 | |
| 38 | 1 | 1 | 0 | 0 | 0 | 0 | 0 | 1 | 1 | 1 | 0 | 0 | 1 | 1 | 1 | 1 | |
| 39 | 1 | 1 | 0 | 0 | 0 | 0 | 0 | 1 | 1 | 1 | 0 | 1 | 1 | 0 | 1 | 0 | |
| 40 | 1 | 1 | 0 | 0 | 0 | 0 | 0 | 1 | 1 | 1 | 1 | 0 | 0 | 1 | 0 | 1 | |
| 41 | 1 | 1 | 0 | 0 | 0 | 0 | 0 | 1 | 1 | 1 | 1 | 1 | 0 | 0 | 0 | 1 | |
| 42 | 1 | 1 | 0 | 0 | 0 | 0 | 0 | 1 | 1 | 1 | 1 | 1 | 1 | 1 | 0 | 1 | |
| 43 | 1 | 1 | 0 | 0 | 0 | 0 | 1 | 1 | 1 | 0 | 0 | 0 | 1 | 0 | 0 | 1 | |
| 44 | 1 | 1 | 0 | 0 | 0 | 0 | 1 | 1 | 1 | 0 | 0 | 1 | 0 | 1 | 0 | 1 | |
| 45 | 1 | 1 | 0 | 0 | 0 | 0 | 1 | 1 | 1 | 0 | 1 | 0 | 0 | 0 | 0 | 1 | |
| 46 | 1 | 1 | 0 | 0 | 0 | 0 | 1 | 1 | 1 | 0 | 1 | 0 | 1 | 1 | 0 | 1 | |
| 47 | 1 | 1 | 0 | 0 | 0 | 0 | 1 | 1 | 1 | 0 | 1 | 1 | 1 | 0 | 0 | 1 | |
| 48 | 1 | 1 | 0 | 0 | 0 | 0 | 1 | 1 | 1 | 1 | 0 | 0 | 0 | 1 | 0 | 1 | |
| 49 | 1 | 1 | 0 | 0 | 0 | 0 | 1 | 1 | 1 | 1 | 0 | 1 | 0 | 0 | 1 | 0 | |
| 50 | 1 | 1 | 0 | 0 | 0 | 0 | 1 | 1 | 1 | 1 | 0 | 1 | 1 | 1 | 1 | 1 | |
| 51 | 1 | 1 | 0 | 0 | 0 | 0 | 1 | 1 | 1 | 1 | 1 | 0 | 1 | 1 | 0 | 0 | |
| 52 | 1 | 1 | 0 | 0 | 0 | 0 | 1 | 1 | 1 | 1 | 1 | 1 | 1 | 0 | 0 | 1 | |
| 53 | 1 | 1 | 0 | 0 | 0 | 1 | 1 | 1 | 1 | 0 | 0 | 0 | 0 | 1 | 1 | 0 | |
| 54 | 1 | 1 | 0 | 0 | 0 | 1 | 1 | 1 | 1 | 0 | 0 | 1 | 0 | 0 | 1 | 1 | |
| 55 | 1 | 1 | 0 | 0 | 0 | 1 | 1 | 1 | 1 | 0 | 1 | 0 | 0 | 0 | 0 | 0 | |
| 56 | 1 | 1 | 0 | 0 | 0 | 1 | 1 | 1 | 1 | 0 | 1 | 0 | 1 | 1 | 0 | 1 | |
| 57 | 1 | 1 | 0 | 0 | 0 | 1 | 1 | 1 | 1 | 0 | 1 | 1 | 1 | 0 | 1 | 0 | |
| 58 | 1 | 1 | 0 | 0 | 0 | 1 | 1 | 1 | 1 | 1 | 0 | 0 | 0 | 1 | 1 | 1 | |
| 59 | 1 | 1 | 0 | 0 | 0 | 1 | 1 | 1 | 1 | 1 | 0 | 1 | 0 | 1 | 0 | 1 | |
| 60 | 1 | 1 | 0 | 0 | 0 | 1 | 1 | 1 | 1 | 1 | 1 | 0 | 0 | 0 | 1 | 1 | |
| 61 | 1 | 1 | 0 | 0 | 0 | 1 | 1 | 1 | 0 | 1 | 1 | 1 | 0 | 0 | 1 | 0 | |
| 62 | 1 | 1 | 0 | 0 | 1 | 1 | 1 | 1 | 1 | 0 | 0 | 0 | 0 | 0 | 0 | 1 | c |
| 63 | 1 | 1 | 0 | 0 | 1 | 1 | 1 | 1 | 1 | 0 | 0 | 1 | 0 | 0 | 0 | 0 | |
| 64 | 1 | 1 | 0 | 0 | 1 | 1 | 1 | 1 | 1 | 0 | 0 | 1 | 1 | 1 | 1 | 1 | |

DRIVING METHOD OF THERMAL PRINTER

FIELD OF THE INVENTION

The present invention relates to a driving method for thermal printer.

BACKGROUND OF THE INVENTION

Conventionally, for example, in a thermal printer for recording an image, as of a hard copy having gradations, on a CRT screen by receiving a corresponding video signal, gradational recording is performed such that pulses are selected from strobe pulses having plural kinds of widths in accordance with a gradation level, and applied to heating elements. However, even with the same combination of pulses, there may occur a difference in density depending on the temperature of a thermal head. Therefore, a density correction is performed in which different combinations of pulses are used even for the same gradation level in accordance with the temperature of the thermal head. More specifically, pulse data (each representing a pulse width and the number of pulses) for respective temperatures of the thermal head and gradation levels are stored in a read only memory (ROM). Pulse data corresponding to a specific gradation level and head temperature are read from the ROM, and heating elements are driven based on the pulse data thus read.

However, in the above conventional driving method, because the quantity of pulse data which should be stored in the ROM for the respective head temperatures and gradation levels is enormous, a large-capacity ROM is required and the cost necessarily increases proportionately. Further since there is not regularity between the head temperature and the pulse data, a combination of pulses most suitable for each head temperature should be determined experimentally. Therefore, it takes a long time to obtain the necessary data.

An objective of the present invention is to provide a driving method of a thermal printer which method enables temperature compensation for gradations with a small quantity of data.

Another objective of the present invention is to provide a driving method of a thermal printer which method can correct density unevenness that would otherwise be caused by a head temperature variation, while requiring the printer to retain only a small quantity of data, by dynamically calculating pulse widths and clock pulse frequencies for different head temperatures.

BRIEF DESCRIPTION OF THE INVENTION

An embodiment of the present invention will be described with reference to the accompanying drawings.

FIG. 2 shows an example of strobe pulse data and basic clock pulse data.

FIG. 3 shows an example of pattern data.

SUMMARY OF THE INVENTION

In a driving method of a thermal printer, in which method heating elements are driven by strobe pulses consisting of preheat pulses and subsequent drive pulses that depend on a gradation level, the preheat pulse width and the frequency of clock pulses that are used to generate the strobe pulses are switched linearly with the temperature of a thermal head unit. In particular, based on data of preheat pulse widths and basic clock pulse frequencies for respective head temperatures, preheat pulse widths and clock pulse frequencies for the other temperatures are calculated.

DETAILED DESCRIPTION OF THE PREFERRED EMBODIMENT

The present invention is directed to what is called a line-type printer which has a number of heating elements arranged in line and which records, on a line-by-line basis, an image of a received video signal for a CRT, etc.

Figure 1:
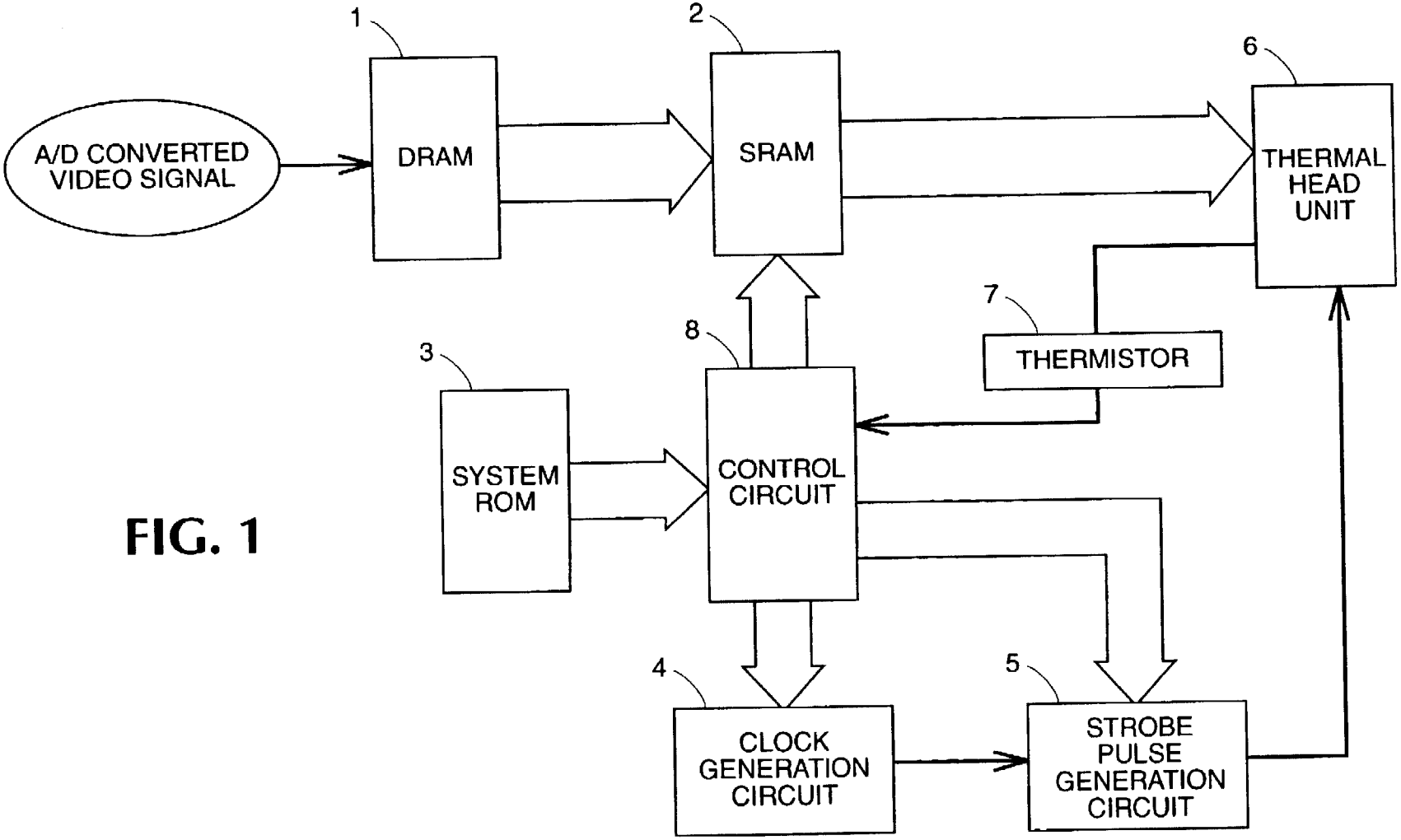
FIG. 1 is a block diagram showing a configuration of the main part of a thermal printer which uses the method according to the present invention.

FIG. 1 shows a configuration of the main part of a thermal printer which uses the method according to the invention. In FIG. 1, a dynamic random access memory (DRAM) 1 temporarily stores gradation data for respective dots of one image. In this embodiment, it is assumed that gradation data for one dot consists of 6 bits and, therefore, can represent 64 gradation levels. Pattern data, each indicating a combination of pulses, among pulses of plural kinds of widths, to be applied to a heating element in accordance with a gradation level, are spread out in a static random access memory (SRAM) 2. Pattern data corresponding to gradation data from the DRAM 1 is output from the SRAM 2. A system read only memory (ROM) 3 stores the pattern data, data for strobe pulses of plural kinds of widths to be applied to the heating elements, and frequency data for basic clock pulses to be used for forming the strobe pulses.

A clock generation circuit 4 for generating the basic clock pulses is comprised of, for instance, a voltage-controlled oscillation circuit, and switches frequencies in accordance with the temperature of a thermal head (described below). Strobe pulse generation circuit 5 generates the strobe pulses based on the basic clock pulses from the clock generation circuit 4 and the strobe pulse data stored in the system ROM 3. Thermal head unit 6 includes a plurality of heating elements for one line (arranged in line) and a driving circuit for driving the respective heating elements, and applies pulses designated by the pattern data from the SRAM 2 to the heating elements. A head detecting element, for example thermistor 7, is provided on a head circuit board in the vicinity of the heating elements and detects the temperature of the thermal head unit 6. Control circuit 8 is a CPU which controls the recording operation for the entire printer.

FIG. 2 shows widths of the strobe pulses and a frequency and period of the basic clock pulses for each temperature range of the thermal head unit 6. In this embodiment, in the column of the head temperature, "2–3," for instance, means a range higher than or equal to 2° C. and lower than 4° C. Among the columns of the pulses constituting the strobe pulses, the two left-most columns show widths of preheat pulses and the other columns show widths of drive pulses.

The drive pulse widths are fixed irrespective of the head temperature. Specifically, the drive pulses consist of the following: 7 pulses having a width of 128 cycles of the basic clock pulse; one pulse having a width of 64 cycles; one pulse having a width of 32 cycles; one pulse having a width of 17 cycles; one pulse having a width of 9 cycles; one pulse having a width of 5 cycles; one pulse having a width of 3 cycles; and, one pulse having a width of 2 cycles. The width of the preheat pulses, however, varies linearly at a rate of 6 cycles of the basic clock pulse per 2° C. of head temperature. The column VCO shows frequencies of the basic clock pulses, and linearly varies at a rate of 0.097 MHz per 2° C. of the head temperature. The right-most column shows periods of the basic clock pulses in nanoseconds (ns).

FIG. 3 shows the pattern data. The pattern data indicate what pulses of the strobe pulses should actually be applied to a heating element for each gradation level. As such, parts of the strobe pulses that are associated with data "1" of the pattern data are selectively applied to a heating element. For example, to print a dot at a gradation level "1" when the head temperature is 1° C., two preheat pulses having a width of 187 cycles of the basic clock pulse, one drive pulse having a width of 64 cycles, one drive pulse having a width of 32 cycles, one drive pulse having a width of 5 cycles, one drive pulse having a width of 3 cycles, and one drive pulse having a width of 2 cycles are selected and applied to a heating element. All the data of the pattern data corresponding to the two preheat pulses have a value "1". Therefore, the two preheat pulses are always applied at respective printing timings.

In this embodiment, the widths of the strobe pulses and the frequency of the basic clock pulse corresponding to the head temperature range "30–31" (see, FIG. 2) are used as basic data. The basic data and the respective pattern data for the gradation levels "1" to "64" (see, FIG. 3) only, are stored in the system ROM 3. The preheat pulse widths and clock pulse frequency for the other head temperature ranges are calculated on each occasion based on the basic data. Therefore, the quantity of data to be stored in the system ROM 3 is much smaller than in the conventional case. Further, to obtain the values shown in FIG. 2, optimum values corresponding to the head temperature range, for instance, "4–5", "30–31" and "50–51", respectively, are determined experimentally and stored, and then the remaining values are determined based on the experimentally determined values so that they vary linearly.

Figure 4:
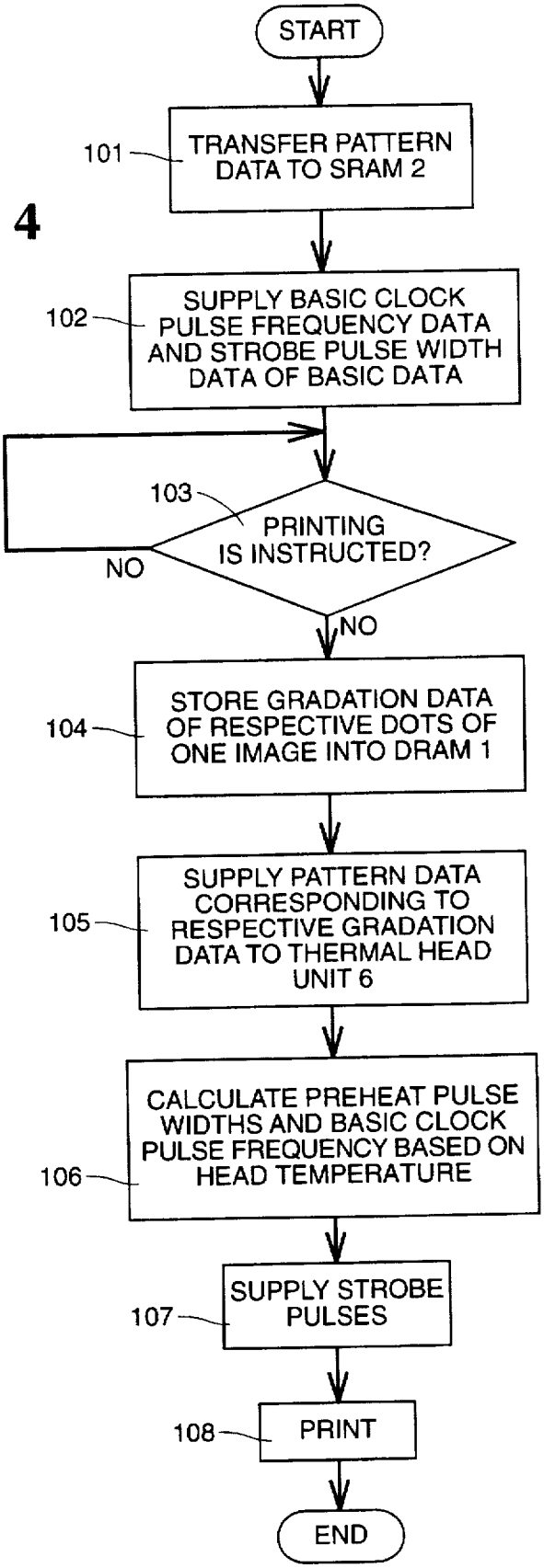
FIG. 4 is a flowchart showing a printing operation.
Figure 5A:
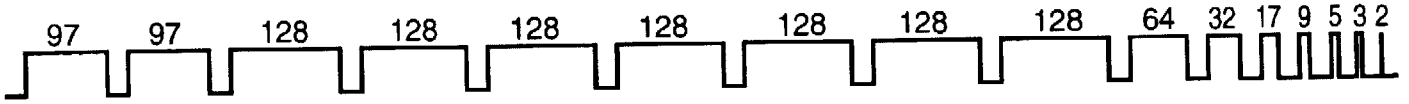
FIGS. 5(A–D) show an example of strobe pulses and pulses to be applied to a heating element.
Figure 5B:
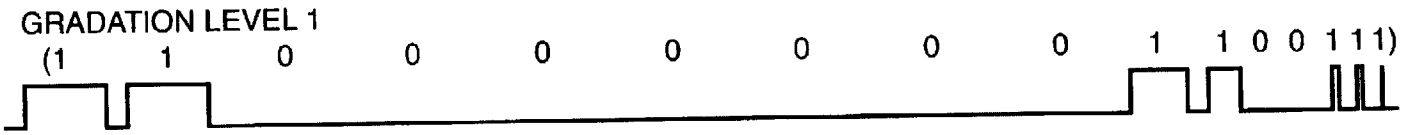
Figure 5C:
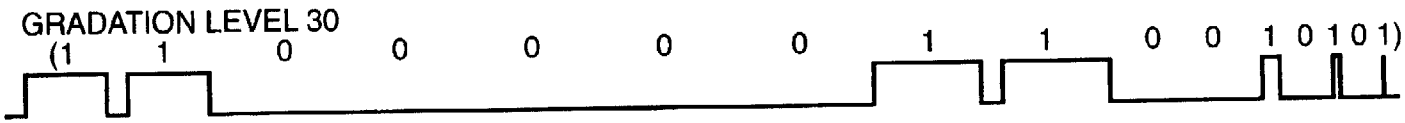
Figure 5D:
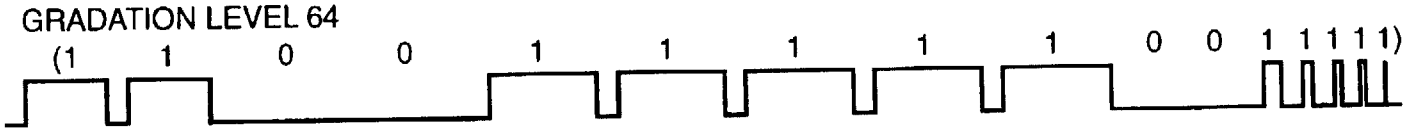
Figure 6A:
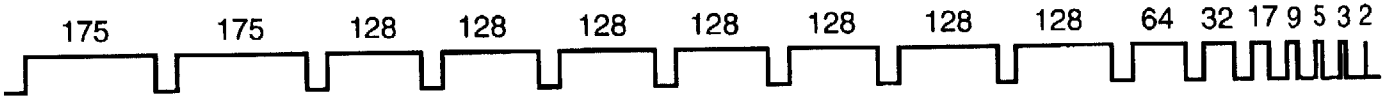
FIGS. 6(A–D) show another example of strobe pulses and pulses to be applied to a heating element.
Figure 6B:
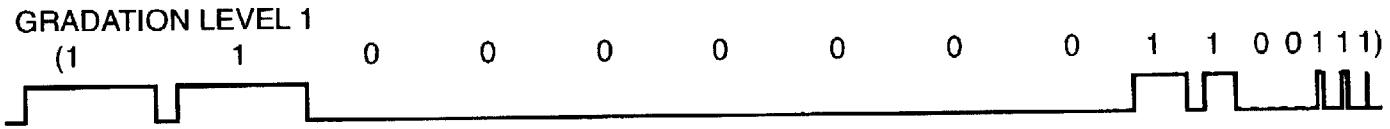
Figure 6C:
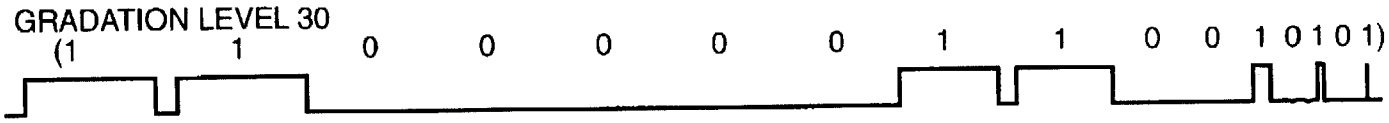
Figure 6D:
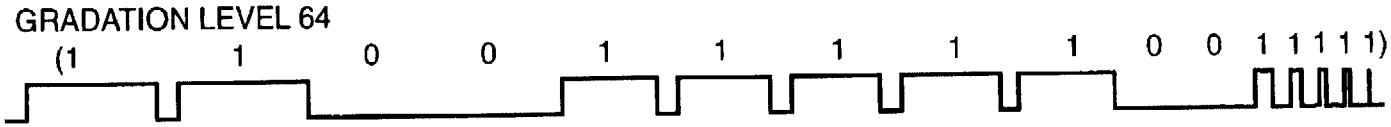

Next, a printing operation that is performed by using the data of FIGS. 2 and 3 will be described with reference to a flowchart of FIG. 4. Upon starting operation, the control circuit 8 causes the pattern data that are stored in the system ROM 3 to be transferred to the SRAM 2 (step 101).

Next, the control circuit 8 causes the basic clock pulse frequency data, from among the basic data stored in the system ROM 3, to be supplied to the clock generation circuit 4, and the strobe pulse width data, from among the stored basic data, to be supplied to strobe pulse generation circuit 5 (step 102). Thus, a printing standby state is established.

Thereafter, upon operation at decision box 103 of a printing instruction means such as a keyboard (not shown), gradation data of respective dots of one image are sent from a sampling means (not shown), for sampling gradation levels of respective dots that constitute a picked-up image, and are stored at the DRAM 1 (step 104).

Then, gradation data of respective dots of one line are transferred from the DRAM 1 to the SRAM 2. The SRAM 2 supplies pattern data corresponding to the respective gradation data to the thermal head unit 6 (step 105).

Meanwhile, having received data indicating the temperature of the thermal head unit 6 as detected by the thermistor 7, the control circuit 8 calculates a difference between the detected temperature and the basic temperature ("30–31" in FIG. 2) and, based on the temperature difference, calculates preheat pulse widths and a basic clock pulse frequency (i.e., values shown in FIG. 2) corresponding to the temperature of the thermal head unit 6. Control circuit 8 supplies the calculated data to the strobe pulse generation circuit 5 and the clock generation circuit 4 (step 106).

The clock generation circuit 4 generates clock pulses at a frequency corresponding to the frequency data received in step E. Receiving the clock pulses thus generated, the strobe pulse generation circuit 5 supplies the thermal head unit 6 with strobe pulses including preheat pulses of widths corresponding to the calculated preheat pulse width data received in step E (step 107).

Based on the pattern data sent from the SRAM 2, the thermal head unit 6 applies strobe pulses associated with data "1" of the pattern data to the heating elements while not applying strobe pulses associated with data "0" of it (step 108).

As an example, a description will be made of specific cases of printing a dot at a gradation level "1," "30" and "64." When the head temperature is 30° C., the preheat pulses are given a width of 97 cycles of the basic clock pulse (see, FIG. 2). The drive pulse width is fixed for the head temperature. Therefore, the strobe pulses have a waveform as shown in FIG. 5(*a*). On the other hand, the pattern data takes forms indicated by a, b and c in FIG. 3 when the gradation level is "1," "30" and "64," respectively. Based on such pattern data and the strobe pulses shown in FIG. 5(*a*), pulses to be applied to a heating element when the head temperature is 30° C. and the gradation level is "1, " "30" and "64" are determined as waveforms shown in FIGS. 5(*b*), 5(*c*) and 5(*d*), respectively. When the head temperature is 30° C., the period for the basic clock pulses is 98.72 ns. Therefore, among various widths of the drive pulses, a width of 128 cycles, for instance, of the basic clock pulse is calculated as 128×98.72 ns=12.6 μs.

When the head temperature is 5° C., the preheat pulses are given a width of 175 cycles of the basic clock pulse (see, FIG. 2). Therefore, the strobe pulses have a waveform as shown in FIG. 6(*a*). When the head temperature is 5° C., the period of the basic clock pulses is 112.75 ns. On the other hand, since the pattern data does not change with respect to the head temperature, it takes forms indicated by a, b and c in FIG. 3 as in the case of the head temperature being 30° C. Based on such pattern data and the strobe pulses shown in FIG. 6(*a*), pulses to be applied to a heating element when the head temperature is 5° C. and the gradation level is "1," "30" and "64" are determined as waveforms shown in FIGS. 6(*b*), 6(*c*) and 6(*d*), respectively. When the head temperature is 5° C., the period of the basic clock pulses is 112.75 ns. Therefore, among various widths of the drive pulses, a width of 128 cycles, for instance, of the basic clock pulse is calculated as 128×112.75 ns=14.4 μs, which is longer than in the case of the head temperature being 30° C.

A dot is printed in the above manner. The operation of above-described steps 101–108 are performed in a parallel manner for the respective heating elements of the thermal head unit 6, so that all dots of one line are printed at the same time.

Figure 7:
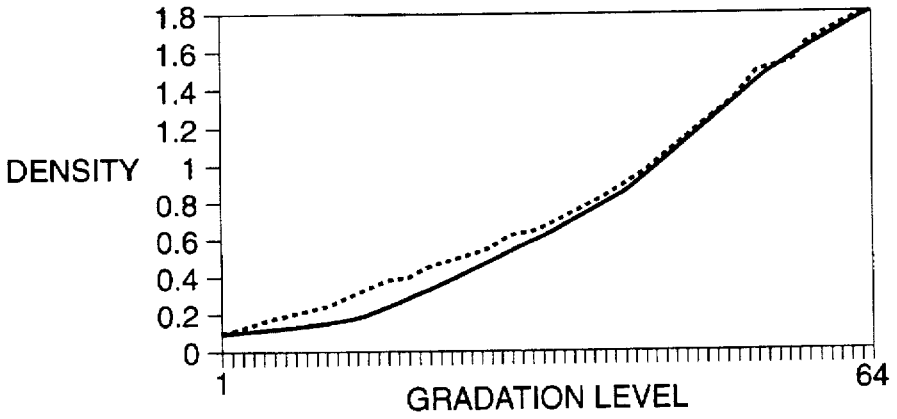
FIG. 7 shows differences in density in the case where only the preheat pulse width is switched in accordance with the head temperature.

While in the above embodiment, both the preheat pulse width and the basic clock pulse frequency are switched in accordance with the head temperature, only one of the two parameters may be switched. In the case of switching only the preheat pulse width, no means is needed for switching the basic clock pulse data and the basic clock pulse frequency. FIG. 7 shows densities for respective gradation levels in the case where only the preheat pulse width is switched. In FIG. 7, the horizontal axis represents the gradation level and the vertical axis represents the density of a dot that is printed at each gradation level. The solid line and the dashed line indicate cases of the head temperature being 30° C. and 5° C., respectively. As shown in FIG. 7, even if maximum densities for the respective head temperatures are equalized by elongating the preheat pulse width as the head temperature decreases, densities obtained when the head temperature is higher are somewhat lower on the low-gradation-level side. But the difference in density is not so large as to cause a problem in visual recognition.

Figure 8:
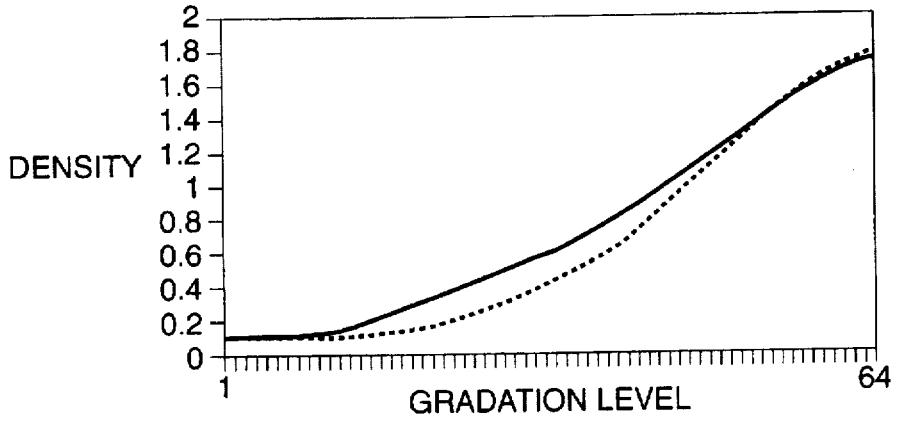
FIG. 8 shows differences in density in the case where only the basic clock pulse frequency is switched in accordance with the head temperature.

On the other hand, in the case of switching only the basic clock pulse frequency, no means is needed for switching the preheat pulse data and the preheat pulse frequency. FIG. 8 shows densities for respective gradation levels in the case where only the basic clock pulse frequency is switched. In FIG. 8, the horizontal axis represents the gradation level and the vertical axis represents the density of a dot that is printed at each gradation level. The solid line and the dashed line indicate cases of the head temperature being 30° C. and 5° C., respectively. As shown in FIG. 8, even if maximum densities for the respective head temperatures are equalized by increasing the frequency as the head temperature decreases, densities obtained when the head temperature is higher are somewhat higher on the low-gradation-level side. But, again, the difference in density is not so large as to cause a problem in visual recognition.

Figure 9:
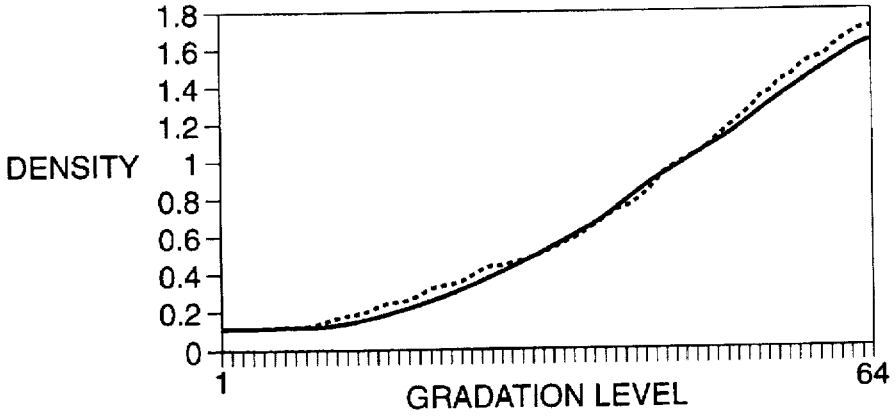
FIG. 9 shows differences in density in the case where both of the preheat pulse width and the basic clock pulse frequency are switched in accordance with the head temperature.

FIG. 9 shows densities for respective gradation levels in the case where both of the preheat pulse width and the basic clock pulse frequency are switched. As described above, the amount of data can be reduced and the configuration can be simplified by switching only one of the preheat pulse width and the basic clock pulse frequency. On the other hand, if both the preheat pulse width and the basic clock pulse frequency are switched as in the above embodiment, the density correction can be performed so that differences between densities obtained for different head temperatures can be made extremely small (see, FIG. 9) as compared to the case where only one of the two parameters is switched.

According to the invention, for each gradation level, temperature correction for the printing density may be performed such that the pattern of the drive pulses is fixed for the thermal head temperature while the preheat pulse width is switched in accordance with the thermal head temperature. As a result, a gradation deviation caused by a head temperature variation can be compensated by use of a very small quantity of stored data.

For each gradation level, the temperature compensation for printing density may be performed such that the pattern of the drive pulses is fixed for the thermal head temperature while the frequency of the basic clock pulses for forming the drive pulses is switched in accordance with the thermal head temperature. As a result, a gradation deviation caused by a head temperature variation can be compensated by use of a very small quantity of data.

For each gradation level, the temperature compensation of the printing density may be performed such that the pattern of the drive pulses is fixed for the thermal head temperature while the preheat pulse width and the frequency of the basic clock pulses for forming the drive pulses are switched in accordance with the thermal head temperature. As a result, a gradation deviation caused by a head temperature variation can be compensated by use of a very small quantity of data.

Since, as described above, the quantity of data necessary to apply the drive pulses to the heating elements is very small, the capacity of a ROM to store data can be made small and the cost of the printer can be reduced proportionately.

The quantity of data can further be reduced because the preheat pulse width and the basic clock pulse frequency for each temperature can easily be computed from the data of the preheat pulse width and the basic clock pulse frequency for the experimental head temperature, by setting the preheat pulse width and/or the basic clock pulse frequency to vary linearly with the thermal head temperature.

Furthermore, the time and labor of acquiring the necessary data is very short and small, because it suffices to obtain data by measurements at, for instance, three prescribed head temperature points, and to set the data for the other head temperatures so that they vary linearly based on the measured data values.

The invention has been described with reference to several preferred embodiments. One having skill in the art may modify the foregoing without departing from the spirit and scope of the appended claims.

What is claimed is:

1. In a method for driving a thermal printer having a printer head to reproduce an image in which method heating elements of the printer head are driven by a preheat pulse having a width and subsequent drive pulses depend on gradation levels in said image, the improvement comprising adjusting the width of the preheat pulse from a first width to a second width wherein the second width of the preheat pulse is calculated based upon the first width of the preheat pulse at a first printer head temperature and upon a second printer head temperature.

2. The method for driving a thermal printer according to claim 1, wherein said adjusting of the width of the preheat pulse from said first width to said second width comprises switching said second pulse width linearly with said second printer head temperature.

3. A method for driving a thermal printer having a printer head to reproduce an image in which method heating elements of the printer head are driven by a preheat pulse and subsequent drive pulses that depend on gradation levels in said image, the improvement comprising adjusting the frequency of a basic clock pulse used to generate the preheat pulse and the drive pulses from a first frequency to a second frequency, wherein the second frequency of the basic clock pulse is calculated based upon the first frequency of the basic clock pulse at a first printer head temperature and upon a second printer head temperature.

4. The method for driving a thermal printer according to claim 3, wherein said adjusting of the frequency of the basic clock pulse from said first frequency to said second frequency comprises adjusting said second frequency linearly with said second printer head temperature.

5. A method for driving a thermal printer having a printer head for reproducing an image wherein heating elements of the printer head are driven by a preheat pulse and subsequent drive pulses that depend on gradation levels in said image, the improvement comprising:

adjusting the width of the preheat pulse and the frequency of a basic clock pulse used to generate the preheat pulse and the drive pulses from a first width and a first frequency to a second width and a second frequency, wherein the second width and the second frequency is calculated based upon the first width and the first frequency at a first printer head temperature and upon a second printer head temperature.

6. The method for driving a thermal printer according to claim 5, wherein said adjusting comprises adjusting the second width of the preheat pulse and the second frequency of the basic clock pulse linearly with the second printer head temperature.

7. A method for determining operating conditions for a thermal printer, said printer having a printer head and including control circuit means for controlling said printer, comprising the steps of:

experimentally determining a first printing parameter for a first printer head temperature range;

storing experimental data comprising said first printing parameter for said first printer head temperature range;

sensing a second printer head temperature range at said printer head; and calculating, at said control circuit means, a second printing parameter for said second printer head temperature range based upon said stored experimental data.

8. The method of claim 7 further comprising applying said second printing parameter at said printer head.

9. The method of claim 7 wherein said calculating comprises calculating said second printing parameter for said second printer head temperature range based upon a difference between said first and said second printer head temperature ranges.

10. The method of claim 9 wherein said storing comprises storing said experimental data for a plurality of first printer head temperature ranges and wherein said calculating comprises linearly computing said second printing parameter for said second printer head temperature range based upon linear differences between the stored experimental data for said plurality of first printer head temperature ranges.

11. The method of claim 7 wherein said first and said second printing parameters comprise first and second preheat pulse widths.

12. The method of claim 7 wherein said first and said second printing parameters comprise first and second clock pulse frequencies.

13. A method for determining operating conditions for a thermal printer, said printer having a printer head and including control circuit means for controlling said printer, comprising the steps of:

experimentally determining at least one first preheat pulse width and at least one first clock pulse frequency for each of at least one first printer head temperature ranges;

storing experimental data comprising said at least one first printer head temperature, said at least one preheat pulse width and said at least one clock pulse frequency for each of said at least one printer head temperature ranges;

sensing a second printer head temperature range at said printer head; and calculating, at said control circuit means, at least one second preheat pulse width and one second clock pulse frequency for said second printer head temperature range based upon said stored experimental data.

14. The method of claim 13 further comprising applying said at least one second preheat pulse width and one second clock pulse frequency at said printer head.

15. The method of claim 13 wherein said calculating comprises calculating at least one second preheat pulse width and one second clock pulse frequency for said second printer head temperature range based upon said stored experimental data and the difference between said first and said second printer head temperature ranges.

16. The method of claim 15 wherein said storing comprises storing said experimental data for a plurality of first printer head temperature ranges and wherein said calculating comprises linearly computing said at least one second preheat pulse width and one second clock pulse frequency for said second printer head temperature based upon the linear differences between the stored experimental values for said plurality of first printer head temperature ranges.

17. In a thermal printer having a printer head, printer head temperature sensing means and a storage location for storing a first printing parameter for a first printer head temperature, the improvement comprising:

control circuit means for calculating a second printing parameter based upon the first printing parameter and upon a second printer head temperature sensed by said printer head temperature sensing means.

* * * * *